US010363478B2

(12) United States Patent
Woodward et al.

(10) Patent No.: US 10,363,478 B2
(45) Date of Patent: Jul. 30, 2019

(54) MOBILE FREEWHEELING PLAYING CARD CART

(71) Applicants: Philip E. Woodward, Boise, ID (US); Betty Jo Woodward, Boise, ID (US)

(72) Inventors: Philip E. Woodward, Boise, ID (US); Betty Jo Woodward, Boise, ID (US)

( * ) Notice: Subject to any disclaimer, the term of this patent is extended or adjusted under 35 U.S.C. 154(b) by 0 days.

(21) Appl. No.: 15/345,257

(22) Filed: Nov. 7, 2016

(65) Prior Publication Data

US 2017/0128820 A1 May 11, 2017

Related U.S. Application Data

(60) Provisional application No. 62/252,231, filed on Nov. 6, 2015.

(51) Int. Cl.
*A63F 1/06* (2006.01)
*A63F 1/10* (2006.01)
*A63F 9/24* (2006.01)

(52) U.S. Cl.
CPC ..... *A63F 1/06* (2013.01); *A63F 1/062* (2013.01); *A63F 1/10* (2013.01); *A63F 2009/2482* (2013.01); *A63F 2009/2494* (2013.01); *A63F 2250/52* (2013.01)

(58) Field of Classification Search
CPC .... A63F 1/06; A63F 1/062; A63F 1/00; A63F 2009/2482
See application file for complete search history.

(56) References Cited

U.S. PATENT DOCUMENTS 4,549,738 A * 10/1985 Greitzer ..... A63F 11/0002 211/58
4,558,865 A * 12/1985 Isgar ..... A63F 3/0434 211/50
4,784,382 A * 11/1988 Myers ..... A47B 19/04 248/460
5,366,227 A * 11/1994 Duffy ..... A63F 11/0002 273/148 A
5,403,013 A * 4/1995 Gilbert ..... A63F 3/00041 273/148 A
8,556,740 B1 * 10/2013 Schneider ..... A63H 33/32 446/465
2005/0266769 A1 * 12/2005 Edwards ..... A63H 17/06 446/454

* cited by examiner

*Primary Examiner* — Michael D Dennis

(74) *Attorney, Agent, or Firm* — Scott D. Swanson; Shaver & Swanson, LLP

(57) ABSTRACT

What is disclosed is a mobile freewheeling playing card cart. The cart has a tray positioned upon a rolling base that is capable of holding two or more stacks of playing cards. The tray features barriers and depressions around the card stacks that make the cards more easily accessible. The cart includes one or more handles used to maneuver the cart. The cart may be motorized through the use of an integrated battery and remote control.

7 Claims, 4 Drawing Sheets

MOBILE FREEWHEELING PLAYING CARD CART

PRIORITY/CROSS-REFERENCE TO RELATED APPLICATIONS

This application claims the benefit of U.S. Provisional Application No. 62/252,231, filed Nov. 6, 2015, the disclosure of which is incorporated by reference.

TECHNICAL FIELD

The presently disclosed and claimed technology generally relates to accessories for card games, and more particularly to playing card carts.

BACKGROUND

Playing card games are often played by a group of people sitting around a table. In some instances, a card game could be played by up to as many as ten or twelve people sitting at a table. Often this table is rectangular in shape or circular in shape. Playing card games are frequently played utilizing a draw deck and a discard deck of cards. When it is a player's turn to draw a card the player will draw from the draw deck. When a player has played a card or discards a card, the player places the card into the discard deck. Difficulty in playing a card game arises when the players are all spaced around the table to the point that each player is unable to reach a static location of a draw deck and a discard deck positioned in the center of the table.

For example, if ten people are playing a card game on a table that is rectangular in shape, for example four feet wide and eight feet long, each player is unable to reach the draw deck and the discard deck if the draw deck and discard deck are located at a static point in the center of the table (or at any other static location on the table). Accordingly, what is needed is a way to make the draw deck and discard deck located on the table into a mobile, dynamic cart.

Several attempts have been made to facilitate the transfer of playing cards and materials around a table. Typically these embodiments feature a compartment attached to a radial arm that is attached to a center of a table. An example of such a system is found in U.S. Pat. No. 4,369,972. The tray is able to rotate on the arm or around the center of the table and allow users at a round table to access the material carried within the compartment tray. However, this feature is not ideal for using at a square or rectangular table at which users sit at varied distances from the center of the table that cannot be reached by a standard sized radial arm.

SUMMARY OF THE DISCLOSURE

The purpose of the Summary is to enable the public, and especially the scientists, engineers, and practitioners in the art who are not familiar with patent or legal terms or phraseology, to determine quickly from a cursory inspection, the nature and essence of the technical disclosure of the application. The Summary is neither intended to define the inventive concept(s) of the application, which is measured by the claims, nor is it intended to be limiting as to the scope of the inventive concept(s) in any way.

What is disclosed is a mobile playing card cart that can be rolled into a new position and thus has dynamic position functionality. While the mobile playing card cart is thought to be beneficial to a wide range of persons and groups, the mobile playing card cart is thought to be of particular importance to handicapped persons and to elderly persons by providing those with limited mobility an easier way to play card games that involve drawing cards from a draw pile and discarding cards into a discard pile. The mobile playing card cart will prevent limited mobility groups from having to test their mobility to reach a draw and/or discard deck of cards by allowing the cards to be placed proximate to the game player by rolling of the cart across a table to the card game player.

In a preferred embodiment, the mobile playing card cart is a freewheeling playing card cart that is not attached to a table or similar surface. The mobile playing card cart has a base. The base can be constructed of a variety of materials, such as acrylic, metal, faux wood, wood, or plastic, or some combination thereof. Other materials may be used as would be understood by one having skill in the art. The base may be a variety of sizes. In one embodiment the base is 14" long and 7.5" wide.

Upon the base is located a tray defining at least two recessed compartments capable of holding a stack of playing cards. The compartments are preferably rectangular to conform to the general shape of a standard playing card, however, compartments of different shapes may be used to accommodate different shaped playing cards. Similarly, the tray can be configured with more than two compartments configured for holding a stack of playing cards. Ideally, the compartments are only slightly larger than the playing cards in order to hold a stack of playing cards in an upright, stacked position. The compartments can be in a variety of depths depending on the number of playing cards or number of decks of playing cards being utilized in the game, with the preferred depth of the compartment being between 1" and 3.5". In general, playing cards are rectangular in shape with a standard playing card being 3.5" in length with a width of 2.5". A bridge sized playing card is 3.5 inches in length by 2.25" in width. In one embodiment, the playing card compartment is slightly longer and wider than a playing card so as to allow for the playing card to be placed into the compartment and removed from the compartment without difficulty.

The barriers defining the compartments may be contiguous or may have breaks to improve access to the card stacks. Combinations of these configurations may be used. For example, in a two compartment tray, the barrier between the compartments may be contiguous, while the barriers located on the remaining sides of the compartments may incorporate openings to facilitate access to the card stacks. The tray may also incorporate depressions in areas around the card stacks to ease the placement and handling of the card stacks, such as when a user seeks to obtain the final card in a compartment.

The bottom of the cart has at least three wheels attached to the base such that said base is configured to roll on said wheels. The wheels may be of many styles, such as fixed, caster, or ball bearing. The playing card cart is free-wheeling, meaning it is not attached to a table or other object that the cart is rolling on and can be directed (such as propelled or pushed) in any direction. In one embodiment the free-wheeling playing card cart has four wheels, although two wheels will also function if placed along an axis of the playing card cart such that the cart is supported by the wheels without falling over. Similarly, three wheels also is envisioned in an embodiment of the invention.

The playing card cart may also incorporate one or more handles to be used to grasp and propel the cart. The handle(s) may be positioned in various locations, such as a single, centrally located handle extending vertically and normal to the base. Alternatively, one or more vertically extending handles may be placed along the edges of the base. Similarly, the handle(s) may extend from the base at an angle or in an orientation generally co-planar with the base. Persons skilled in the art understand that other orientations and locations are available. These handles, like the rest of the playing card cart, may be constructed of a variety of materials and may be ergonomically shaped to maximize comfort of the user.

In one embodiment, the cart may also incorporate one or more additional basins to hold things other than playing cards, such as tokens, dice, or other playing card accessories. The basins may also be used to hold snacks. The playing card cart can be mounted on tracks, similar to railroad tracks, for long tables.

The cart could be made with a porous material such that the cart could be stained or painted. The cart can be decorated or painted in colors of sports teams or a wide variety of images that may be popular with the user.

The freewheeling playing card cart can be made to be propelled by exterior force or the freewheeling playing card cart can be motorized, such that a motor drives propulsion of the freewheeling playing card cart. In one embodiment, the motorized cart is driven by a motor assembly made up of a motor, a battery, and a drivetrain couple to one or more wheels. The batteries can be disposable (removable) batteries or rechargeable batteries. In one embodiment, the motor is powered by an integrated rechargeable battery that can be attached to a power source to be recharged. This motor can be attached to a remote control such that a player at the table (or any third party) can control the direction and movement of the cart. The cart conceivably could be placed under automated control or through the use of sensors to deliver the cart to players as their turn approaches in a game.

Still other features and advantages of the presently disclosed and claimed inventive concept(s) will become readily apparent to those skilled in this art from the following detailed description describing preferred embodiments of the inventive concept(s), simply by way of illustration of the best mode contemplated by carrying out the inventive concept(s). As will be realized, the inventive concept(s) is capable of modification in various obvious respects all without departing from the inventive concept(s). Accordingly, the drawings and description of the preferred embodiments are to be regarded as illustrative in nature, and not as restrictive in nature.

DETAILED DESCRIPTION OF THE EXEMPLARY EMBODIMENTS

Figure 1:
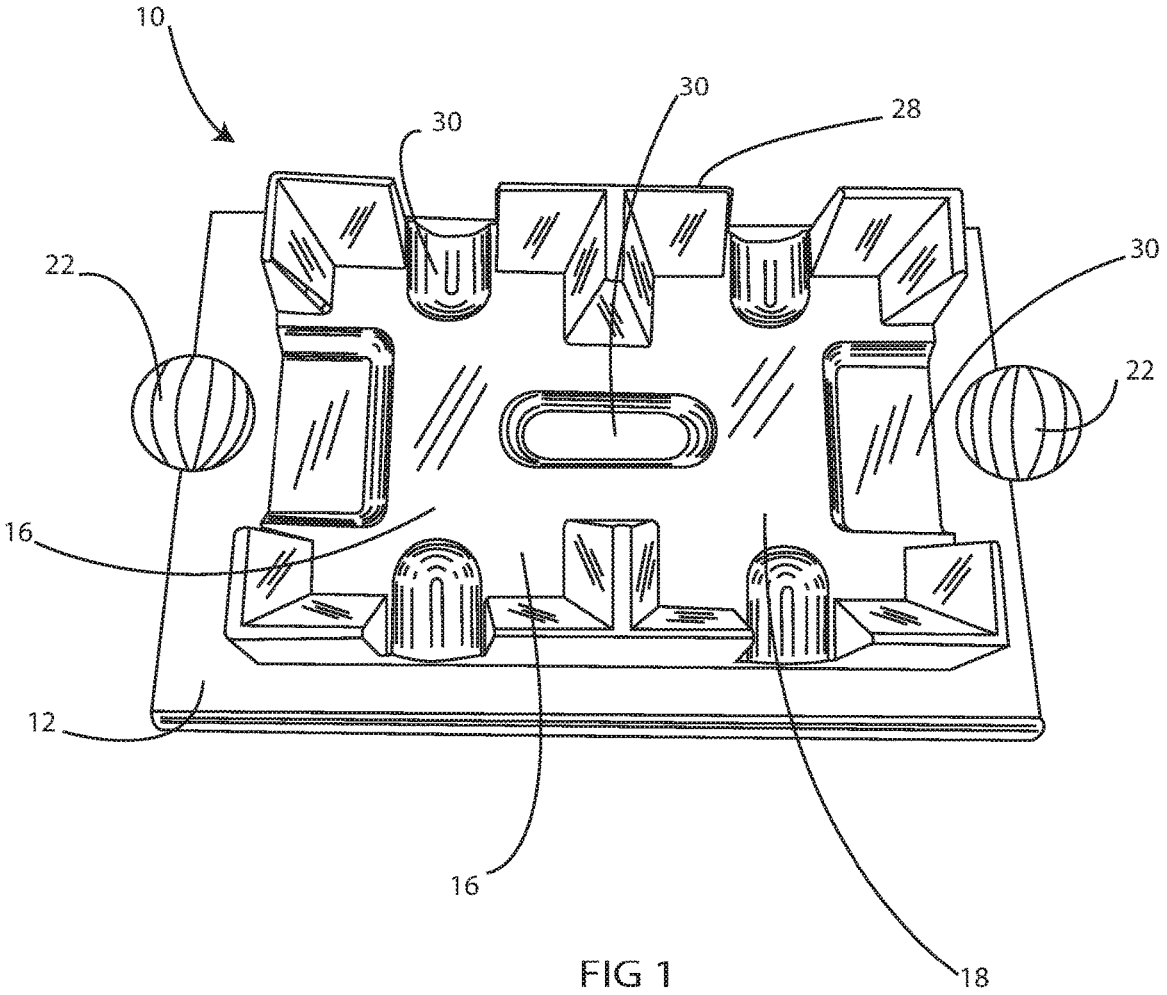
FIG. 1 illustrates a perspective top view of a freewheeling mobile playing card cart.

While the presently disclosed inventive concept(s) is susceptible of various modifications and alternative constructions, certain illustrated embodiments thereof have been shown in the drawings and will be described below in detail. It should be understood, however, that there is no intention to limit the inventive concept(s) to the specific form disclosed, but, on the contrary, the presently disclosed and claimed inventive concept(s) is to cover all modifications, alternative constructions, and equivalents falling within the spirit and scope of the inventive concept(s) as defined in the claims.

FIG. 1 illustrates a top view of a freewheeling mobile playing card cart 10 having two compartments 16, 18 for receiving a stack of cards. The playing card cart 10 is made up of a base 12 upon which is attached a tray 14 that has card retaining compartments 16, 18. The card retaining compartments 16, 18 are generally shaped to be configured to retain a stacked deck of cards. The compartments 16, 18 are defined by barriers 28 capable of retaining the cards within the compartments 16, 18. The barriers 28 may be contiguous, or have openings as desired.

Depending on the height of the barriers 28, the compartments 16, 18 can be configured to hold multiple decks of cards. Generally these compartments will be 1 inch to 3.5 inches recessed from the top of the playing tray 14, though additional dimensions may be used if needed. The playing card cart has, in one embodiment, one or more handles 22 the user can grasp to pull or push the card cart 10.

The embodiment shown in FIG. 1 includes multiple openings in the barriers 28 defining the compartments 16, 18. These barriers improve accessibility to the card stacks during play. The embodiment shown also includes depressions 30 strategically places around portions of the compartments 16, 18 to further facilitate access to the card stacks.

Figure 2:
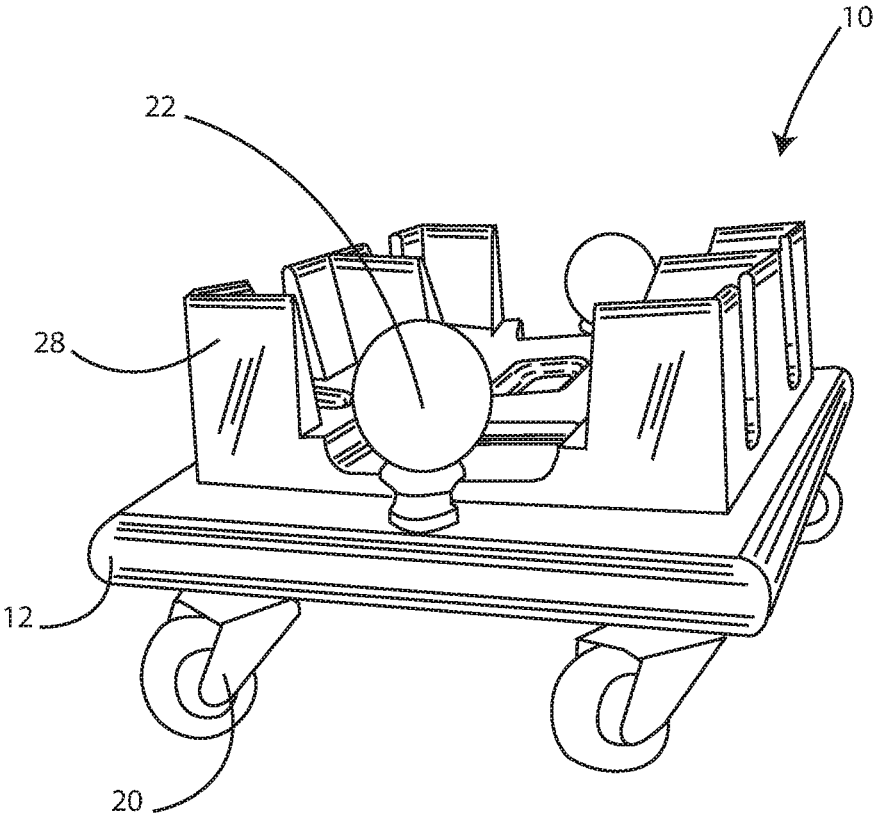
FIG. 2 is a perspective side view of the freewheeling card cart.

FIG. 2 is a perspective side view of the playing card cart. The playing card cart in the depicted embodiment has swivel caster wheels 20 that allow the playing card cart to roll along a table. While the wheels can be manufactured from a variety of materials and in a variety of functional mechanisms, in a preferred embodiment the wheels can be fixed, caster, ball bearing wheels or a combination of the three. The depressions 30 are visible in the embodiment shown in FIG. 2 as well.

Figure 3:
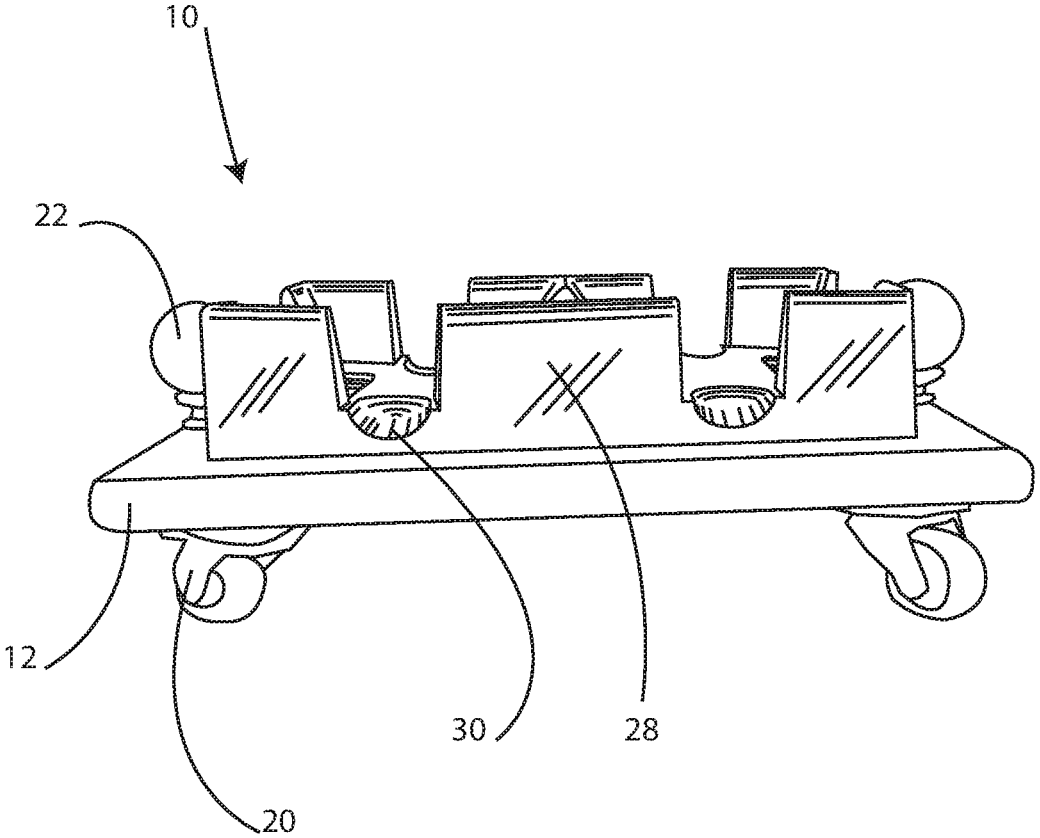
FIG. 3 is a different perspective side view of the freewheeling card cart.

FIG. 3 is an alternative perspective side view of the playing card cart. FIG. 3 describes the base 12, tray 14, wheels 20, and handles 22. The depressions 30 are visible in the embodiment shown in FIG. 3 as well.

Figure 4:
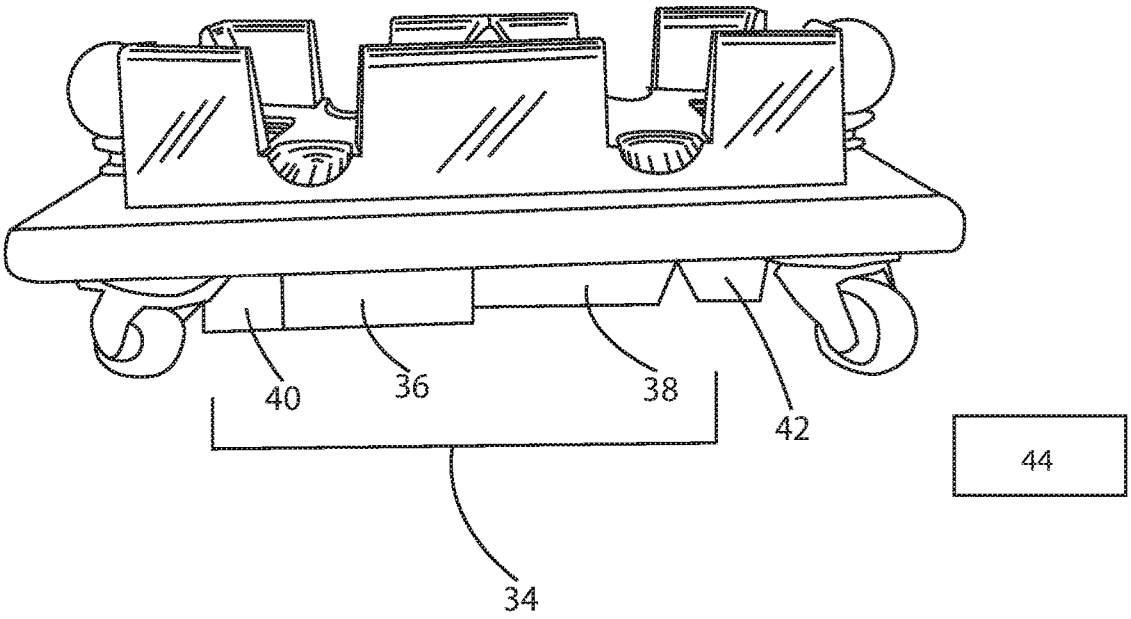
FIG. 4 is a perspective side view of the freewheeling card cart showing the motor assembly and remote control features.

The playing card cart of FIG. 4 includes a motor assembly 34 for propelling the playing card cart 10 on a table. The motor assembly 34 includes a motor 36, a battery 38, and a drivetrain 40 coupled to one or more wheels 20. The battery 38 may be standard or rechargeable. The battery may be integrated or removable from the cart. In one embodiment, the playing card cart 10 is remote controlled such that the propulsion speed and direction are remotely controllable by a user. In this embodiment, the cart 10 includes a receiver 42 and a remote transmitter 44 capable of communicating with and controlling the cart 10. This allows a user to direct the playing card cart on a table to people playing the game involving the playing cards.

Each of the units can also be made to include a basin area that can function as a snack bowl or area for holding dice, markers or monetary change. The card cart can have non swivel wheels and be mounted on tracks, similar to railroad tracks, for long tables. The cart could be made with a porous material such that the unit could be stained or painted. The mobile cart can be decorated or painted in colors of sports teams or a wide variety of images that may be popular with the user.

While the presently disclosed inventive concept(s) is susceptible of various modifications and alternative constructions, certain illustrated embodiments thereof have been shown in the drawings and will be described below in detail. It should be understood, however, that there is no intention to limit the inventive concept(s) to the specific form disclosed, but, on the contrary, the presently disclosed and claimed inventive concept(s) is to cover all modifications, alternative constructions, and equivalents falling within the spirit and scope of the inventive concept(s) as defined in the claims.

I claim:

1. A freewheeling playing card cart, comprising: a base, wherein said base comprises a tray having at least two playing card compartments on a top of said tray, wherein said playing card compartments are configured to accept and retain a stack of playing cards, wherein said playing card compartments comprise a generally rectangular shape; at least three swivel wheels attached to said base such that said base is configured to roll on said wheels in any direction in a 360 degree radius; and wherein said playing card cart is free-wheeling, wherein said playing cart is configured to be used on a table top; wherein said cart comprises one or more handles, and wherein said base defines a plane and said one or more handles are located at opposing ends of said base and extend vertically and normal to said plane.

2. The freewheeling playing card cart of claim 1, wherein said cart comprises four caster wheels.

3. The freewheeling playing card cart of claim 1, wherein one or more said compartments are defined by one or more barriers.

4. The freewheeling playing card cart of claim 1, wherein said one or more handles comprise knobs, wherein said knobs extend upward from said base and are oriented on a face of said base between said at least two playing card compartments and an edge of said base.

5. The freewheeling playing card cart of claim 1, wherein said at least two playing card compartments comprise adjoining playing card compartments separated by a divider, wherein said playing card compartments comprise walls extending upward from said base and configured to retain playing cards in said compartments.

6. The freewheeling playing card cart of claim 1, wherein said playing card compartments comprise at least one void in each wall configured to allow for a player to access said cards in said compartment.

7. A freewheeling playing card cart, wherein said cart comprises: a base, wherein said base comprises a tray having at least two recessed compartments on a top of said tray, wherein said recessed compartments are defined by one or more barriers and configured to accept a stack of playing cards; said tray containing depressions proximate to said compartments; four swivel caster wheels attached to said base such that said base is configured to roll on said caster wheels; one or more handles; and wherein said playing card tray is free-wheeling and rollable on said wheels in a 360 degree direction, wherein said playing cart is configured to be used on a table top; wherein said base defines a plane and said one or more handles are located at opposing ends of said base and extend vertically and normal to said plane.

* * * * *